US007880712B2

(12) United States Patent
Lee

(10) Patent No.: US 7,880,712 B2
(45) Date of Patent: Feb. 1, 2011

(54) LIQUID CRYSTAL DISPLAY DEVICE AND METHOD OF DRIVING THE SAME

(75) Inventor: Dong Jin Lee, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 870 days.

(21) Appl. No.: 11/819,448

(22) Filed: Jun. 27, 2007

(65) Prior Publication Data

US 2008/0043004 A1 Feb. 21, 2008

(30) Foreign Application Priority Data

Jun. 29, 2006 (KR) ..... 10-2006-0059340

(51) Int. Cl.
*G09G 3/36* (2006.01)

(52) U.S. Cl. ..... 345/99; 345/100; 345/89; 345/204; 345/690

(58) Field of Classification Search ..... 345/87–103, 345/204, 690, 698–699
See application file for complete search history.

(56) References Cited

U.S. PATENT DOCUMENTS

2003/0048246 A1* 3/2003 Ham ..... 345/87
2003/0095088 A1* 5/2003 Ham ..... 345/87
2004/0196229 A1* 10/2004 Ham ..... 345/87
2005/0001972 A1* 1/2005 Roosendaal et al. ..... 349/179
2005/0057471 A1* 3/2005 Lu et al. ..... 345/89
2005/0073494 A1* 4/2005 Baek et al. ..... 345/100
2005/0140616 A1* 6/2005 Sohn et al. ..... 345/87
2005/0156851 A1* 7/2005 Yun ..... 345/98

FOREIGN PATENT DOCUMENTS

CN 1637495 7/2005
FR KR-10-2004-0104572 * 6/2006

* cited by examiner

*Primary Examiner*—Lun-Yi Lao
(74) *Attorney, Agent, or Firm*—Morgan, Lewis & Bockius LLP

(57) ABSTRACT

An LCD device and a method of driving the same are disclosed, to improve a picture quality by realizing a rapid response speed, wherein the LCD device comprises an image display part which includes liquid crystal cells formed in respective regions defined by a plurality of gate and data lines; a timing controller which modulates data inputted according to a first frame frequency to modulation data to realize a rapid response speed of liquid crystal, and outputs the modulation data or data to a second frame frequency; a gate driver which generates gate on voltages under control of the timing controller, and supplies the gate on voltages to the gate lines in sequence; and a data driver which converts the modulation data or data supplied from the timing controller to a data voltage, and supplies the data voltage to the data line in synchronization with the gate on voltage.

14 Claims, 6 Drawing Sheets

LIQUID CRYSTAL DISPLAY DEVICE AND METHOD OF DRIVING THE SAME

The present invention claims the benefit of Korean Patent Application No. 10-2006-0059340, filed in Korea on Jun. 29, 2006, which is hereby incorporated by reference in its entirety.

BACKGROUND OF THE INVENTION

1. Field of the Invention

The present invention relates to a liquid crystal display (LCD) device, and more particularly, to an LCD device to improve a picture quality by realizing a rapid response speed, and a method of driving the same.

2. Discussion of the Related Art

Generally, LCD devices adjust light transmittance of liquid crystal cells according to a video signal so as to display images. An active matrix (AM) type LCD device which has a switching element formed for every liquid crystal cell is suitable for the display of moving images. A thin film transistor (hereinafter, referred to as a TFT) is mainly used as the switching element in the AM type LCD device.

However, the LCD device has a relatively low response speed due to the characteristics of the inherent viscosity and the elasticity of liquid crystal, as can be seen from the following equations 1 and 2:

$$\tau_r \propto \frac{\gamma d^2}{\Delta\varepsilon|Va^2 - V_F^2|} \quad \text{[Equation 1]}$$

where $\tau_r$ is a rising time when a voltage is applied to the liquid crystal, Va is the applied voltage, $V_F$ is a Freederick transition voltage at which liquid crystal molecules start to be inclined, d is a liquid crystal cell gap, and $\gamma$ is the rotational viscosity of the liquid crystal molecules.

$$\tau_F \propto \frac{\gamma d^2}{K} \quad \text{[Equation 2]}$$

where $\tau_F$ is a falling time when the liquid crystal is returned to its original position owing to an elastic restoration force after the voltage applied to the liquid crystal is turned off, and K is the inherent elastic modulus of the liquid crystal.

In a twisted nematic (TN) mode, although the response speed of the liquid crystal may be varied based on the speed of the physical properties and cell gap of the liquid crystal, it is common that the rising time is 20 to 80 ms and the falling time is 20 to 30 ms. Because this liquid crystal response speed is longer than one frame period (16.67 ms in National Television Standards Committee NTSC) of a moving image, the response of the liquid crystal proceeds to the next frame before a voltage being charged on the liquid crystal reaches a desired level, as shown in FIG. 1, resulting in motion blurring in which an afterimage is left in the eyeplane.

With reference to FIG. 1, a related art LCD device cannot express a desired color and brightness for display of moving images in that, when data VD is changed from one level to another level, the corresponding display brightness level BL is unable to reach a desired value due to a slow response of the liquid crystal display device. As a result, the motion blurring occurs in the moving image, causing degradation in contrast ratio and display quality.

SUMMARY OF THE INVENTION

Accordingly, the present invention is directed to an LCD device and a method of driving the same that substantially obviates one or more problems due to limitations and disadvantages of the related art.

An object of the present invention is to provide an LCD device to improve a picture quality by realizing a rapid response speed, and a method of driving the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an LCD device includes an image display part which includes liquid crystal cells formed in respective regions defined by a plurality of gate and data lines; a timing controller which modulates data inputted according to a first frame frequency to modulation data to realize a rapid response speed of liquid crystal, and outputs the modulation data or data to a second frame frequency; a gate driver which generates gate on voltages under control of the timing controller, and supplies the gate on voltages to the gate lines in sequence; and a data driver which converts the modulation data or data supplied from the timing controller to a data voltage, and supplies the data voltage to the data line in synchronization with the scan pulse.

In another aspect, a method of driving an LCD device having an image display part provided with a plurality of liquid crystal cells formed in respective regions defined by a plurality of gate and data lines includes a first step to modulate data inputted according to a first frame frequency to modulation data to realize a rapid response speed of liquid crystal, and to supply the modulation data or data to a second frame frequency; a second step to supply gate on voltages to the gate lines in sequence; and a third step to convert the modulation data or data to data voltages, and to supply the data voltages to the data lines in synchronization with the scan pulse.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understand of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Hereinafter, an LCD device according to the present invention and a method of driving the same will be described with reference to the accompanying drawings.

Figure 1:
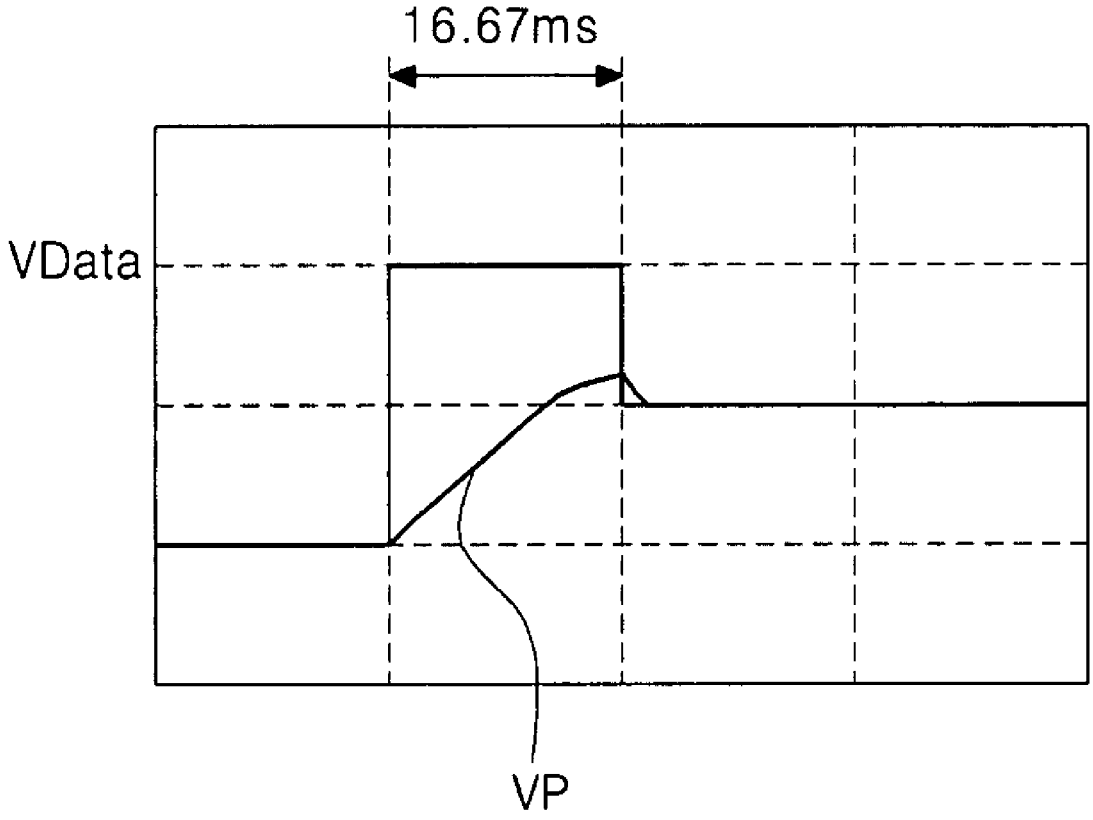
FIG. 1 Related Art
FIG. 1 is a waveform view of illustrating a liquid crystal cell voltage based on data of an LCD device according to the related art.
Figure 2:
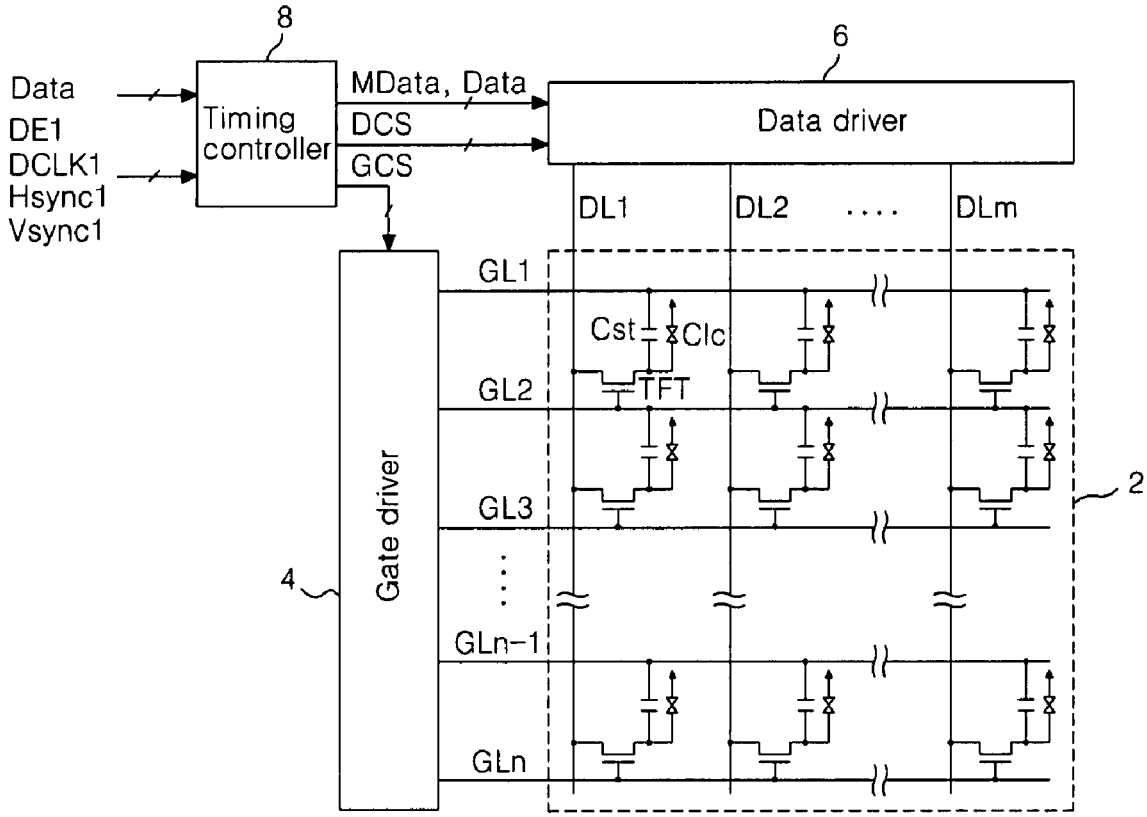
FIG. 2 is a schematic view of illustrating an LCD device according to the preferred embodiment of the present invention.

FIG. 2 is a schematic view of illustrating an LCD device according to the preferred embodiment of the present invention.

Referring to FIG. 2, the LCD device according to the preferred embodiment of the present invention includes an image display part 2 which includes a plurality of liquid crystal cells formed in respective regions defined by 'n' gate lines (GL1 to GLn) and 'm' data lines (DL1 to DLm); a timing controller 8 which modulates data (Data) inputted based on a first frame frequency to modulation data (MData) to realize a rapid response speed of liquid crystal, and outputs the modulation data (MData) or data (Data) to a second frame frequency; a gate driver 4 which generates gate on voltages under control of the timing controller 8, and supplies the generated gate on voltages to the gate lines (GL1 to GLn) in sequence; and a data driver 6 which converts the modulation data (MData) or data (Data) supplied from the timing controller 8 into analog data voltages, and supplies the analog data voltages to the data lines (DL1 to DLm) in synchronization with the gate on voltages.

The image display part 2 includes a thin film transistor array substrate and a color filter array substrate bonded to each other; and a liquid crystal layer filled in a space between the two substrates maintained at a predetermined interval by spacers. Also, the image display part 2 includes thin film transistors (TFT) formed in the regions defined by the 'n' gate lines (GL1 to GLn) and 'm' data lines (DL1 to DLm); and the liquid crystal cells electrically connected to the thin film transistors (TFT).

Each of the thin film transistors (TFT) supplies the data voltage of the data line (DL1 to DLm) to the liquid crystal cell in response to the scan pulse.

Each liquid crystal cell can be equivalently expressed as a liquid crystal capacitor (Clc) because it is provided with a common electrode facing via the liquid crystal, and a pixel electrode connected to the thin film transistor (TFT). This liquid crystal cell includes a storage capacitor (Cst) which maintains the analog data voltage charged on the liquid crystal capacitor (Clc) until the next analog data voltage is charged thereon.

Figure 3:
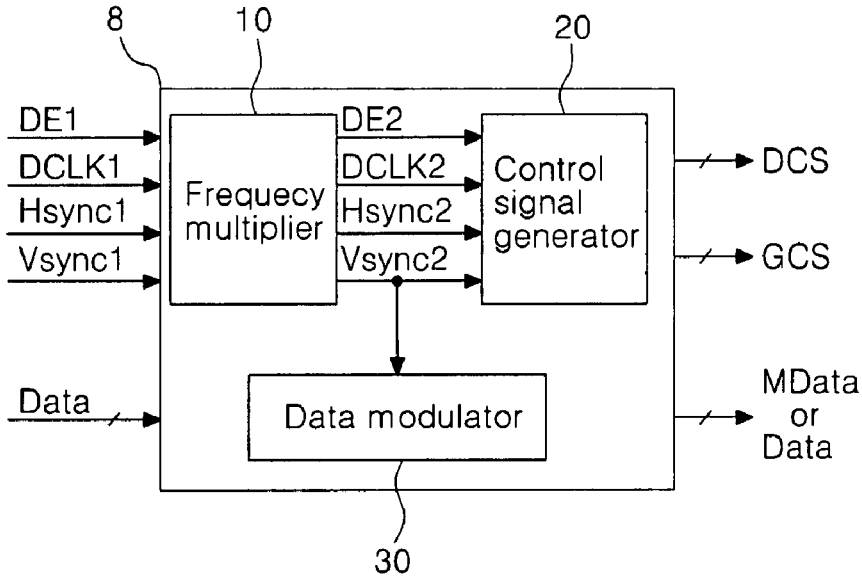
FIG. 3 is a block diagram of illustrating a timing controller shown in FIG. 2.

As shown in FIG. 3, the timing controller 8 includes a frequency multiplier 10, a control signal generator 20, and a data modulator 30. The frequency multiplier 10 multiples a first frame synchronization signal corresponding to the first frame frequency supplied from the external by two, to thereby generate a second frame synchronization signal corresponding to the second frame frequency. The first frame synchronization signal includes a first dot clock (DCLK1), a first data enable (DE1), a first horizontally synchronized signal (Hsync1), and a first vertically synchronized signal (Vsync1). In this case, the first frame frequency is 60 Hz.

The control signal generator 20 generates a gate control signal (GCS) and a data control signal (DCS) using the second frame synchronization signal (DCLK2, DE2, Hsync2, Vsync2). The gate control signal (GCS) controls a driving timing of the gate driver 4, wherein the gate control signal (GCS) includes a gate start pulse (SSP), a gate shift clock (GSC), and a gate output enable (GOE). The data control signal (DCS) controls a driving timing of the data driver 6, wherein the data control signal (DCS) includes a source output enable (SOE), a source shift clock (SSC), a source start pulse (SS), and a polarity control signal (POL).

Figure 4:
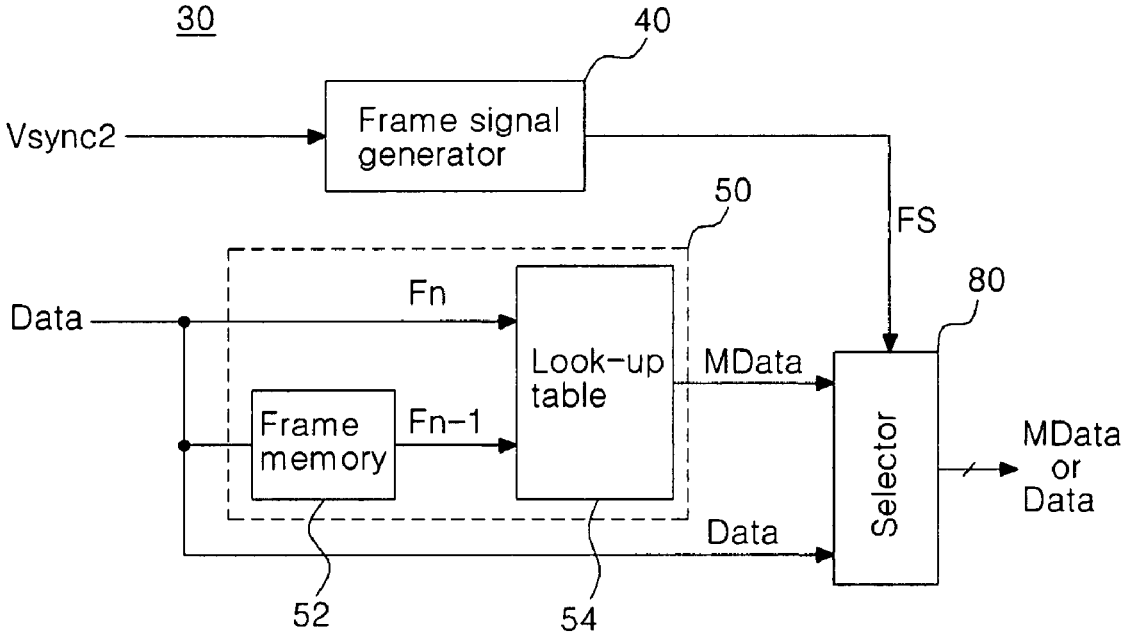
FIG. 4 is a block diagram of illustrating a data modulator shown in FIG. 3 according to the first embodiment of the present invention.

As shown in FIG. 4, the data modulator 30 according to the first embodiment of the present invention includes a frame signal generator 40, a modulation data generator 50, and a selector 80.

The frame signal generator 40 generates the second frame frequency, that is, a frame signal (FS) according to the second vertically synchronized signal (Vsync2) supplied from the frequency multiplier 10. In case of the odd-numbered one of the second vertically synchronized signal (Vsync2), the frame signal generator 40 generates the frame signal (FS) of the low state for one frame. In case of the even-numbered one of the second vertically synchronized signal (Vsync2), the frame signal generator 40 generates the frame signal (FS) of the high state for one frame.

The modulation data generator 50 includes a frame memory 52 and a look-up table 54. At this time, the frame memory 52 stores the data (Data) of the current frame (Fn) inputted from the external by each frame unit. The look-up table 54 compares the data (Data) of the current frame (Fn) with the data of the previous frame (Fn−1), and generates the modulation data (MData) to realize the rapid response speed of liquid crystal.

The selector 80 selects the data (Data) of the current frame (Fn) inputted from the external and the modulation data (MData) supplied from the modulation data generator 50 according to the frame signal (FS) supplied from the frame signal generator 40; and supplies the modulation data (MData) and the data (Data) of the current frame (Fn) to the data driver 6. That is, the selector 80 selects the modulation data (Mdata) according to the frame signal (FS) of the low state, and supplies the selected modulation data (MData) to the data driver 6; and selects the data (Data) according to the frame signal (FS) of the high state, and supplies the selected data (Data) to the data driver 6.

In FIG. 2, the gate driver 4 includes a shift register which sequentially generates the gate on voltages in response to the gate control signal (GCS) outputted from the timing controller 8. The gate driver 4 supplies the gate on voltages to the gate lines (GL) in sequence, whereby the thin film transistor (TFT) connected to the gate line (GL) is turned-on.

The data driver 6 converts the modulation data (MData) or data (Data) supplied from the timing controller 8 to the data voltage in response to the data control signal (DCS) supplied from the timing controller 8; and supplies the data voltage for one horizontal line to the data lines (DL) by each one horizontal period to supply the gate on voltage to the gate line (GL). At this time, the data driver 6 inverts the polarity of the data voltage supplied to the data lines (DL) in response to the polarity control signal (POL).

For the LCD device according to the preferred embodiment of the present invention, the data (Data) inputted according to the first frame frequency is modulated to the modulation data (MData) to realize the rapid response speed of liquid crystal, and the modulation data (MData) or data (Data) is displayed on the image display part 2 according to the second frame frequency, to thereby improve the picture quality with the rapid response speed of liquid crystal.

Figure 5:
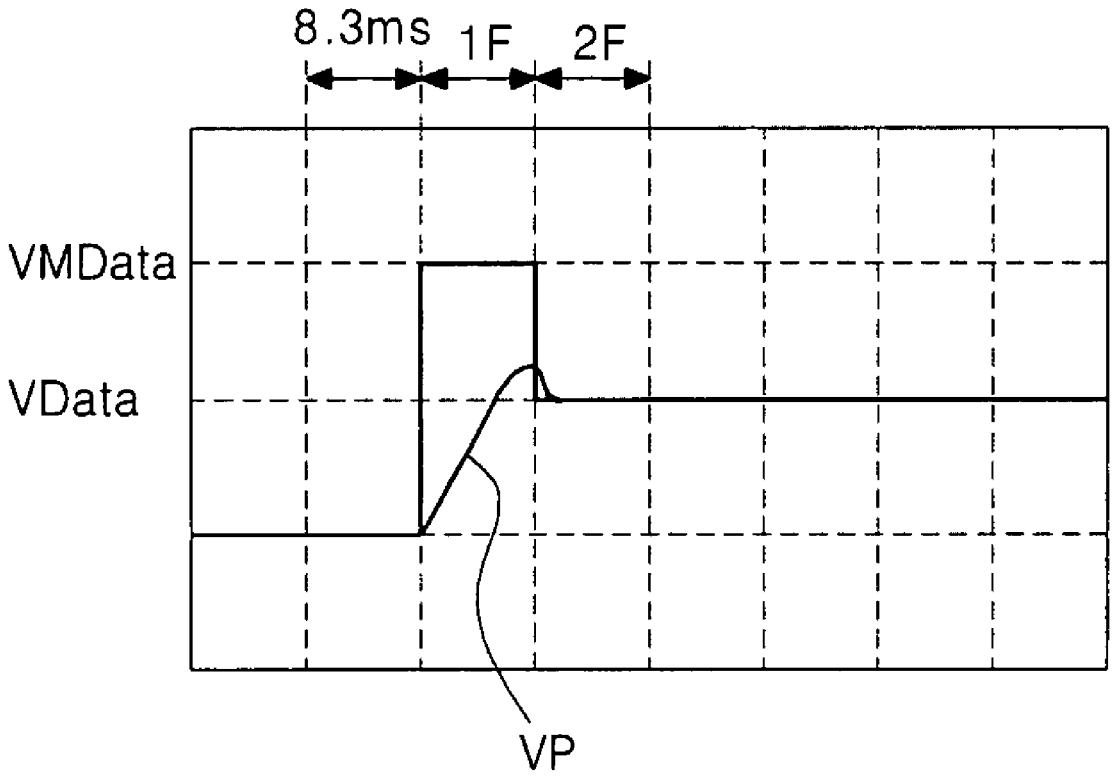
FIG. 5 is a waveform view of illustrating a liquid crystal cell voltage based on data in a method of driving an LCD device according to the first embodiment of the present invention.

For the LCD device according to the preferred embodiment of the present invention, as shown in FIG. 5, after the modulation data voltage (VMData) corresponding to the modulation data (MData) is supplied to the liquid crystal cell for the odd-numbered frame (1F) of the second frame frequency, the data voltage (VData) corresponding to the data (Data) is supplied to the liquid crystal cell for the even-numbered frame (2F) of the second frame frequency. Accordingly, after the liquid crystal cell is charged with a voltage value above a target voltage (VP) for the odd-numbered frame (1F), the liquid crystal cell is maintained at the target voltage (VP) for the even-numbered frame (2F).

Figure 6:
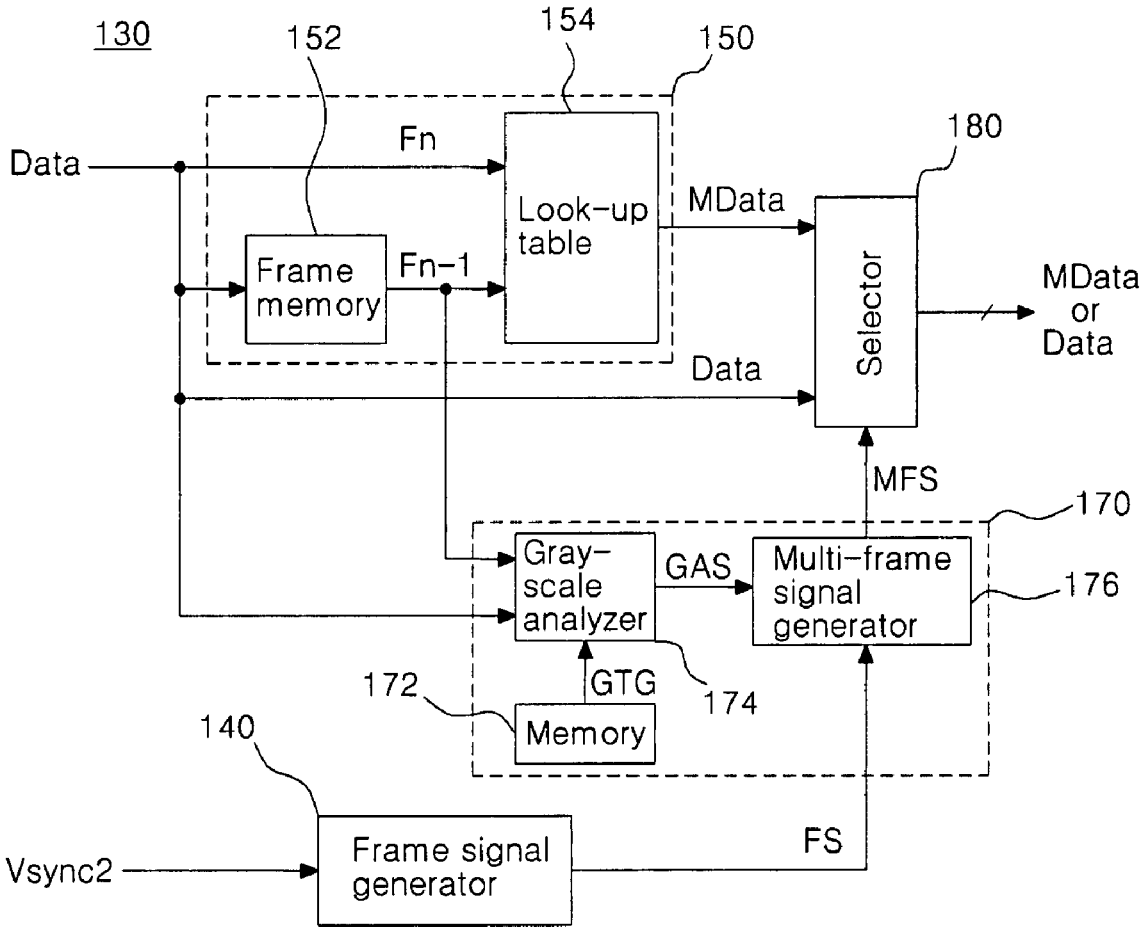
FIG. 6 is a block diagram of schematically illustrating a data modulator shown in FIG. 3 according to the second embodiment of the present invention.

FIG. 6 is a block diagram of illustrating a data modulator according to the second embodiment of the present invention. Referring to FIG. 6 in connection with FIGS. 2 and 3, the data modulator 130 includes a frame signal generator 140, a modulation data generator 150, a frame-setting unit 170, and a selector 180.

The frame signal generator 140 generates a frame signal (FS) according to the second vertically synchronized signal (Vsync2) outputted from the frequency multiplier 110. In case of the odd-numbered one of the second vertically synchronized signal (Vsync2), the frame signal generator 140 generates the frame signal (FS) of the low state for one frame. In case of the even-numbered one of the second synchronized signal (Vsync2), the frame signal generator 140 generates the frame signal (FS) of the high state for one frame.

The modulation data generator 150 includes a frame memory 152 and a look-up table 154. At this time, the frame memory 152 stores the data (Data) of the current frame (Fn) inputted from the external by each frame unit. The look-up table 154 compares the data (Data) of the current frame (Fn) with the data of the previous frame (Fn−1) supplied from the frame memory 152, and generates the modulation data (MData) to realize the rapid response speed of liquid crystal.

The frame-setting unit 170 includes a memory 172, a gray-scale analyzer 174, and a multi-frame signal generator 176.

If driving the image display part 2 by the second frame frequency, the memory 172 records gray to gray (GTG) information and data in relation to the case where the response speed of liquid crystal is longer than one frame of the second frame frequency when the data voltage (Vdata) is shifted from one level to another level. For example, if the second frame frequency is 120 Hz, one frame is 8.3 ms. In this case, the memory 172 records the gray to gray (GTG) information in relation to the response time above 8.3 ms. If the gray scale is shifted from 0 to 255, on assumption that the response time of liquid crystal is 8.7 ms, there is the GTG information in relation to the shift of the gray scales of 0 to 255.

The gray-scale analyzer 174 compares the gray-scale of the data (Data) of the current frame (Fn) inputted from the external with the gray-scale of the data of the previous frame (Fn−1) supplied from the frame memory 152 of the modulation data generator 150. If the comparison result corresponds to the GTG information recorded in the memory 172, the gray-scale analyzer 174 generates a gray-scale analyzing signal (GAS) of a high state. If not, the gray-scale analyzer 174 generates a gray-scale analyzing signal (GAS) of a low state.

The multi-frame signal generator 176 generates a multi-frame signal (MFS) according to the gray-scale analyzing signal (GAS) supplied from the gray-scale analyzer 174 and the frame signal (FS) supplied from the frame signal generator 140, as shown in the following table 1. As shown in the following table 1, the multi-frame signal generator 176 generates the multi-frame signal (MFS) of the low state without regard to the gray-scale analyzing signal (GAS) if the frame signal (FS) is in the low state; and the multi-frame signal generator 176 generates the multi-frame signal (MFS) of the high state without regard to the frame signal (FS) if the gray-scale analyzing signal (GAS) is in the high state; and the multi-frame signal generator 176 generates the multi-frame signal (MFS) of the low state if the frame signal (FS)) and the gray-scale analyzing signal (GAS are in the high state;

TABLE 1

| Frame signal (FS) | Gray-scale analyzing signal (GAS) | Multi-frame signal (MFS) |
|---|---|---|
| Low | Low | Low |
| Low | High | Low |
| High | Low | High |
| high | High | Low |

The selector 180 selects the modulation data (MData) supplied from the modulation data generator 150 and the data (Data) of the current frame (Fn) supplied from the external according to the multi-frame signal (MFS) supplied from the multi-frame signal generator 176 of the frame-setting unit 170; and supplies the selected data to the data driver 6. That is, the selector 180 selects the modulation data (MData) according to the multi-frame signal (MFS) of the low state, and supplies the selected modulation data (MData) to the data driver 6. Also, the selector 180 selects the data (Data) according to the multi-frame signal (MFS) of the high state, and supplies the selected data (Data) to the data driver 6.

A driving method of the data modulator 130 according to the second embodiment of the present invention will be explained as follows.

The following explains the case where the response time of one liquid crystal cell corresponding to the gray-scale change between the current data and the previous data is shorter than one frame.

First, the frame signal generator 140 generates the frame signal (FS) of the low state corresponding to the odd-numbered frame according to the second vertically synchronized signal (Vsync2). Then, the data modulator 150 generates the modulation data (MData) according to the gray-scale change between the current data (Data) inputted from the external and the previous data in one liquid crystal cell.

Simultaneously, if the gray-scale change between the current data (Data) inputted from the external and the previous data in one liquid crystal cell doesn't correspond to the GTG information recorded in the memory 172, the gray-scale analyzer 174 of the frame-setting unit 170 generates the gray-scale analyzing signal (GAS) of the low state. Also, the multi-frame signal generator 176 of the frame-setting unit 170 generates the multi-frame signal (MFS) of the low state according to the frame signal (FS) of the low state, as shown in the above-mentioned table 1, and supplies the multi-frame signal (MFS) of the low state to the selector 180. Accordingly, the selector 180 supplies the modulation data (MData) of the look-up table 154 to the data driver 6.

Then, the frame signal generator 140 generates the frame signal (FS) of the high state corresponding to the even-numbered frame according to the second vertically synchronized signal (Vsync2). Then, the multi-frame signal generator 176 generates the multi-frame signal (MFS) of the high state according to the frame signal (FS) of the high state and the gray-scale analyzing signal (GAS) of the low state, and supplies the multi-frame signal (MFS) of the high state to the selector 180. Accordingly, the selector 180 supplies the current data (Data) of one liquid crystal cell inputted from the external to the data drier 6.

The following explains the case where the response time of liquid crystal cell corresponding to the gray-scale change between the current data and the previous data is longer than one frame.

First, the frame signal generator 140 generates the frame signal (FS) of the low state corresponding to the odd-numbered frame according to the second vertically synchronized signal (Vsync2). Then, the data modulator 150 generates the modulation data (MData) according to the gray-scale change between the current data (Data) inputted from the external and the previous data in one liquid crystal cell.

Simultaneously, if the gray-scale change between the current data (Data) inputted from the external and the previous data in one liquid crystal cell correspond to the GTG information recorded in the memory 172, the gray-scale analyzer 174 of the frame-setting unit 170 generates the gray-scale analyzing signal (GAS) of the high state. Also, the multi-frame signal generator 176 of the frame-setting unit 170 generates the multi-frame signal (MFS) of the low state according to the frame signal (FS) of the low state, as shown in the above-mentioned table 1, and supplies the multi-frame signal (MFS) of the low state to the selector 180. Accordingly, the selector 180 supplies the modulation data (MData) of the look-up table 154 to the data driver 6.

Then, the frame signal generator 140 generates the frame signal (FS) of the high state corresponding to the even-numbered frame according to the second vertically synchronized signal (Vsync2). Also, the multi-frame signal generator 176 generates the multi-frame signal (MFS) of the low state according to the frame signal (FS) of the high state and the gray-scale analyzing signal (GAS) of the high state, and supplies the multi-frame signal (MFS) of the low state to the selector 180. Accordingly, the selector 180 supplies the modulation data (MData) of the look-up table 154 to the data driver 6.

For the LCD device including the data modulator 130 according to the second embodiment of the present invention, the data (Data) inputted according to the first frame frequency is modulated to the modulation data (MData) to realize the rapid response speed of liquid crystal; and the modulation data (MData) or data (Data) is successively displayed based on the GTG information of the data (Data) by the multi-frame, thereby improving the picture quality with the rapid response speed of liquid crystal.

In detail, if the response time of liquid crystal cell corresponding to the gray-scale change between the current data and the previous data is shorter than one frame, the modulation data voltage (VMData) corresponding to the modulation data (MData) is supplied to the liquid crystal cell for the odd-numbered frame (1F) of the second frame frequency, and then the data voltage (Vdata) corresponding to the input data (Data) is supplied to the liquid crystal cell for the even-numbered frame (2F) of the second frame frequency. Thus, after the liquid crystal cell is charged with the voltage level above the target voltage for the odd-numbered frame (1F), the liquid crystal cell is maintained at the target voltage for the even-numbered frame (2F).

Figure 7:
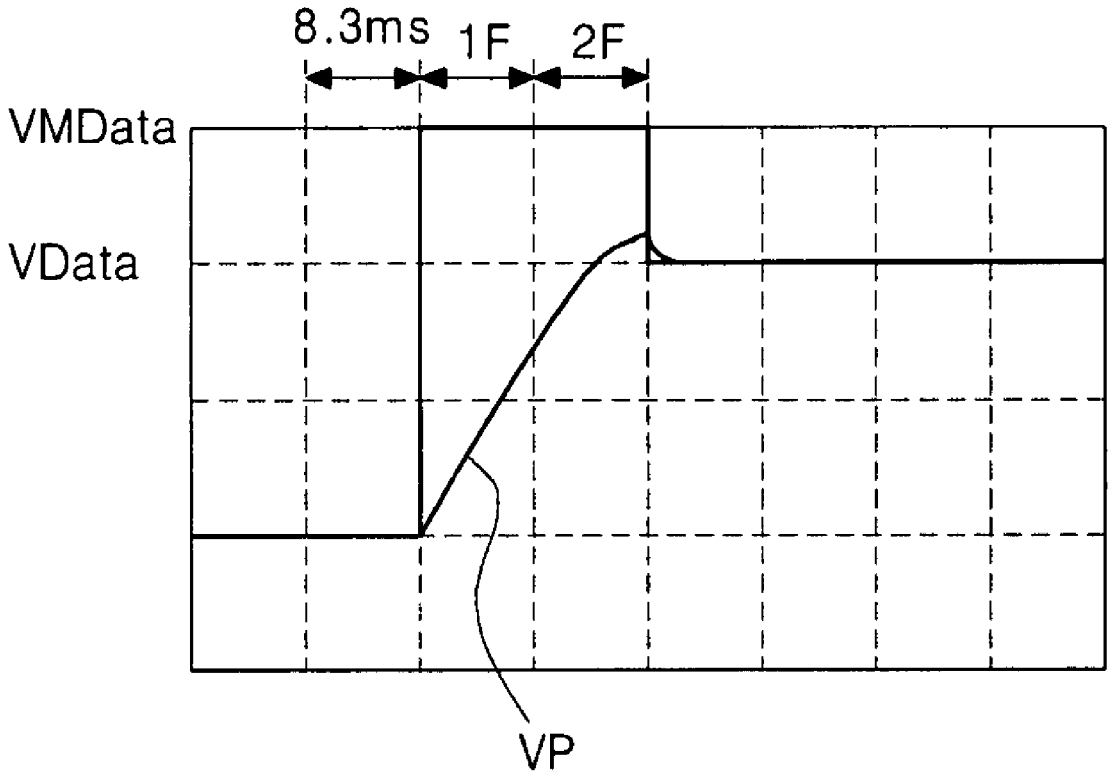
FIG. 7 is a waveform view of illustrating a liquid crystal cell voltage based on data in a method of driving an LCD device according to the second embodiment of the present invention.

In the meantime, if the response time of liquid crystal cell corresponding to the gray-scale change between the current data and the previous data is longer than one frame, the modulation data voltage (VMData) corresponding to the gray-scale change is driven by the multi-frame, thereby realizing the rapid response speed of liquid crystal. That is, as shown in FIG. 7, after the modulation data voltage (VMData) corresponding to the gray-scale change is supplied to the liquid crystal cell for the odd-numbered frame (1F) on the basis of the multi-frame signal (MFS) of the high state, the liquid crystal cell is supplied with the modulation data voltage (VMData) instead of the current data voltage (VData) for the even-numbered frame (2F).

For the data modulator 130 according to the second embodiment of the present invention, if the response time of liquid crystal cell for the gray-scale change between the current data and the previous data is longer than one frame, the adjacent two frames are supplied with the same modulation data voltage (VMData). However, it is not limited to the two frames. That is, the three or more frames may be supplied with the same modulation data voltage (VMData).

As mentioned above, the LCD device according to the present invention and the method of driving the same have the following advantages.

For the LCD device according to the present invention and the method of driving the same, the data inputted according to the first frame frequency is modulated to the modulation data to realize the rapid response speed of liquid crystal, and the modulation data or data is displayed on the image display part according to the second frame frequency, thereby improving the picture quality with the rapid response speed of liquid crystal.

Also, the data inputted according to the first frame frequency is modulated to the modulation data to realize the rapid response speed of liquid crystal; the modulation data or data is displayed on the image display part according to the second frame frequency; and the modulation data is successively displayed by the multi-frame on the basis of the change in GTG information of the data, thereby improving the picture quality with the rapid response speed of liquid crystal.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An LCD device comprising:

an image display part which includes liquid crystal cells formed in respective regions defined by a plurality of gate and data lines;

a timing controller which modulates data inputted according to a first frame frequency to modulation data to realize a rapid response speed of liquid crystal, and outputs the modulation data or data to a second frame frequency;

a gate driver which generates gate on voltages under control of the timing controller, and supplies the gate on voltages to the gate lines in sequence; and a data driver which converts the modulation data or data supplied from the timing controller to a data voltage, and supplies the data voltage to the data line in synchronization with gate on voltage, wherein the timing controller comprises:

a frequency multiplier which multiples a first frame synchronization signal including a first vertically synchronized signal of the first frame frequency by two, and generates a second frame synchronization signal including a second vertically synchronized signal of the second frame frequency;

a control signal generator which generates control signals to control the gate and data drivers by the second frame synchronization signal; and a data modulator which modulates the data to the modulation data, and outputs the modulation data or data to the second frame frequency, wherein the data modulator comprises:

a frame signal generator which generates a frame signal of a first logic state corresponding to an odd-numbered frame and a frame signal of a second logic state corresponding to an even-numbered frame according to the second vertically synchronized signal;

a modulation data generator which compares the data of current frame with the data of previous frame, and generates the modulation data and a selector which selects the modulation data or data according to the frame signal, and supplies the selected data to the data driver, wherein the selector selects the modulation data according to the frame signal of the first logic state, and supplies the modulation data to the data driver; and the selector selects the data according to the frame signal of the second logic state, and supplies the data to the data driver.

2. The LCD device of claim 1, wherein the modulation data generator comprises:

a frame memory which stores the data of current frame by each frame unit; and a look-up table which compares the data of current frame with the data of previous frame, and generates the modulation data.

3. The LCD device of claim 1, wherein the first frame frequency is 60 Hz.

4. An LCD device comprising:

an image display part which includes liquid crystal cells formed in respective regions defined by a plurality of gate and data lines;

a timing controller which modulates data inputted according to a first frame frequency to modulation data to realize a rapid response speed of liquid crystal, and outputs the modulation data or data to a second frame frequency;

a gate driver which generates gate on voltages under control of the timing controller, and supplies the gate on voltages to the gate lines in sequence; and a data driver which converts the modulation data or data supplied from the timing controller to a data voltage, and supplies the data voltage to the data line in synchronization with gate on voltage, wherein the timing controller comprises:

a frequency multiplier which multiples a first frame synchronization signal including a first vertically synchronized signal of the first frame frequency by two, and generates a second frame synchronization signal including a second vertically synchronized signal of the second frame frequency;

a control signal generator which generates control signals to control the gate and data drivers by the second frame synchronization signal; and a data modulator which modulates the data to the modulation data, and outputs the modulation data or data to the second frame frequency, wherein the data modulator comprises:

a frame signal generator which generates the frame signal of a first logic state corresponding to an odd-numbered frame, and the frame signal of a second logic state corresponding to an even-numbered frame according to the second vertically synchronized signal;

a modulation data generator which compares the data of current frame with the data of previous frame, and generates the modulation data;

a frame-setting unit which generates a multi-frame signal by the frame signal and gray-scale analyzing signal corresponding to the gray-scale change between the data of current frame and the data of previous frame; and a selector which selects the modulation data or data on the basis of the multi-frame signal, and supplies the selected data to the data driver.

5. The LCD device of claim 4, wherein the modulation data generator includes:

a frame memory which stores the data of current frame by each frame unit; and a look-up table which compares the data of current frame with the data of previous frame from the frame memory, and generates the modulation data.

6. The LCD device of claim 5, wherein the frame-setting unit comprises:

a memory which records gray to gray (GTG) information if a response time of liquid crystal cell corresponding to the gray-scale change of the data is longer than one frame of the second frame frequency;

a gray-scale analyzer which generates a gray-scale analyzing signal of the second logic state if the gray-scale change of the data corresponds to the GTG information, and generates a gray-scale analyzing signal of the first logic state if not; and a multi-frame signal generator which generates the multi-frame signal by the gray-scale analyzing signal and the frame signal.

7. The LCD device of claim 6, wherein the multi-frame signal generator generates the multi-frame signal of the first logic state in case of the frame signal of the first logic state; generates the multi-frame signal of the second logic state in case of the frame signal of the second logic state and the gray-scale analyzing signal of the first logic state; and generates the multi-frame signal of the first logic state in case of the frame signal of the second logic state and the gray-scale analyzing signal of the second logic state.

8. The LCD device of claim 7, wherein the selector selects the modulation data according to the multi-frame signal of the first logic state, and supplies the selected modulation data to the data driver; and the selector selects the data according to the multi-frame signal of the second logic state, and supplies the selected data to the data driver.

9. A method of driving an LCD device having an image display part provided with a plurality of liquid crystal cells formed in respective regions defined by a plurality of gate and data lines comprising:

a first step to modulate data inputted according to a first frame frequency to modulation data to realize a rapid response speed of liquid crystal, and to supply the modulation data or data to a second frame frequency;

a second step to supply gate on voltages to the gate lines in sequence; and a third step to convert the modulation data or data to data voltages, and to supply the data voltages to the data lines in synchronization with the gate on voltage, wherein the first step comprises:

a first-first step to multiply a first frame synchronization signal including a first vertically synchronized signal of the first frame frequency by two, and to generate a second frame synchronization signal including a second vertically synchronized signal of the second frame frequency; and a first-second step to modulate the data to the modulation data, and to output the modulation data or data to the second frame frequency, wherein the first-second step comprises:

generating the frame signal of a first logic state corresponding to an odd-numbered frame and the frame signal of a second logic state corresponding to an even-numbered frame according to the second vertically synchronized signal;

generating the modulation data by comparing the data of current frame with the data of previous frame; and selecting the modulation data or data according to the frame signal, wherein selecting the data selects the modulation data according to the frame signal of the first logic state, and selects the data according to the frame signal of the second logic state.

10. The method of claim 9, wherein generating the modulation data comprises:

storing the data of current frame in the frame memory by each frame unit; and generating the modulation data by comparing the data of current frame with the data of previous frame from the frame memory.

11. A method of driving an LCD device having an image display part provided with a plurality of liquid crystal cells formed in respective regions defined by a plurality of gate and data lines comprising:

a first step to modulate data inputted according to a first frame frequency to modulation data to realize a rapid response speed of liquid crystal, and to supply the modulation data or data to a second frame frequency;

a second step to supply gate on voltages to the gate lines in sequence; and a third step to convert the modulation data or data to data voltages, and to supply the data voltages to the data lines in synchronization with the gate on voltage, wherein the first step comprises:

a first-first step to multiply a first frame synchronization signal including a first vertically synchronized signal of the first frame frequency by two, and to generate a second frame synchronization signal including a second vertically synchronized signal of the second frame frequency; and a first-second step to modulate the data to the modulation data, and to output the modulation data or data to the second frame frequency, wherein the first-second step comprises:

generating the frame signal of a first logic state corresponding to an odd-numbered frame or the frame signal of a second logic state corresponding to an even-numbered frame according to the second vertically synchronized signal;

generating the modulation data by comparing the data of current frame with the data of previous frame;

generating the multi-frame signal by using the frame signal and the gray-scale analyzing signal corresponding to the gray-scale change between the data of current frame and the data of previous frame; and selecting the modulation data or data according to the multi-frame signal.

12. The method of claim 11, wherein generating the modulation data comprises:

storing the data of current frame in the frame memory by each frame unit; and generating the modulation data by comparing the data of current frame with the data of previous frame.

13. The method of claim 12, wherein generating the multi-frame signal comprises:

generating the gray-scale analyzing signal of the second logic state if the gray-scale change of the data corresponds to the GTG information, and generating the gray-scale analyzing signal of the first logic state if the gray-scale change of the data doesn't correspond to the GTG information; and generating the multi-frame signal by the gray-scale analyzing signal and the frame signal, wherein the GTG information is related with the data of current frame and the data of previous frame if the response time of liquid crystal cell corresponding to the gray-scale change of the data is longer than the time period for one frame of the second frame frequency.

14. The method of claim 13, wherein generating the multi-frame signal comprises:

generating the multi-frame signal of the first stage if applying the frame signal of the first logic state;

generating the multi-frame signal of the second logic state if applying the frame signal of the second logic state and the gray-scale analyzing signal of the first logic state; and generating the multi-frame signal of the first logic state if applying the frame signal of the second logic state and the gray-scale analyzing signal of the second logic state.

* * * * *